US005868009A

United States Patent [19]

Walker

[11] Patent Number: 5,868,009

[45] Date of Patent: Feb. 9, 1999

[54] PROCESS FOR MAKING REINFORCING FABRIC USED IN AUTOMOTIVE RADIATOR HOSES

[75] Inventor: Ricky D. Walker, Aberdeen, N.C.

[73] Assignee: Aberdeen Fabrics, Incorporated, Aberdeen, N.C.

[21] Appl. No.: 909,175

[22] Filed: Aug. 11, 1997

[51] Int. Cl.[6] ..... D04B 21/20

[52] U.S. Cl. ..... 66/170; 66/195

[58] Field of Search ..... 66/169 R, 172 R, 66/170, 195, 198, 201, 190, 191, 192, 193; 442/304, 312, 313, 314

[56] References Cited

U.S. PATENT DOCUMENTS

| | | | |
|---|---|---|---|
| 2,365,268 | 12/1944 | Herter Jr. . | |
| 3,673,820 | 7/1972 | Sarimento | 66/193 |
| 3,710,599 | 1/1973 | Sarmiento | 66/193 |
| 3,981,310 | 9/1976 | Donaghy | 66/195 |
| 4,551,994 | 11/1985 | Vailati et al. | 66/193 |
| 4,608,290 | 8/1986 | Schnegg | 66/192 |
| 4,845,963 | 7/1989 | Parekh . | |
| 4,888,229 | 12/1989 | Paley et al. . | |
| 5,053,269 | 10/1991 | Ducol et al. . | |

*Primary Examiner*—William Stryjewski
*Assistant Examiner*—Larry D. Worrell, Jr.
*Attorney, Agent, or Firm*—Kennedy Covington Lobdell & Hickman, LLP

[57] ABSTRACT

A process for making a fabric to be used as reinforcing material in rubber products like automotive radiator hoses comprises: first warp-knitting a mesh textile fabric having a lengthwise extending main fabric body formed in an open mesh stitch pattern and lengthwise extending fabric selvedges respectively adjoining opposite side margins of the main fabric body for defining the lengthwise side edges of the fabric, each selvedge being formed with a sufficient width to naturally lay substantially flat in an open-width condition of the fabric against any tendency of the side margins of the main fabric body to induce curling of the selvedges; applying a stiffening resin to the mesh textile fabric prior to passing the mesh textile fabric through a tenter frame for heat setting the mesh textile fabric; and then passing the mesh textile fabric only once through a tenter frame for drying the resin and for heat setting the mesh textile fabric. The stiffening resin used is preferably melamine and the fabric is preferably passed through the tenter frame at speeds up to thirty to forty yards per minute.

16 Claims, 3 Drawing Sheets

PROCESS FOR MAKING REINFORCING FABRIC USED IN AUTOMOTIVE RADIATOR HOSES

BACKGROUND OF THE INVENTION

The present invention relates generally to warp-knitted textile fabrics and, more particularly, to a warp-knitted fabric knitted of an open mesh construction with selvedges adapted to resist any tendency of the side margins of the fabric to induce curling.

Many constructions of textile fabrics exhibit an inherent tendency to curl at the free edges of the fabric, which can be particularly problematic in that such curling makes the fabric difficult to wind into a uniformly cylindrical roll form and additionally makes the fabric difficult to handle, both manually and using automated machinery.

Such problems can be particularly acute with fabrics of an open mesh construction. For example, one known type of open mesh fabric is formed of a warp-knitted construction forming diamond-shaped mesh openings, which may be used for reinforcing natural or synthetic rubber products such as in the manufacture of pressurized fluid-carrying hoses (e.g. automotive radiator hoses). To render such fabrics suitable for such uses, the fabrics must be heat set, usually by transport through a tenter frame, and a suitable resin, such as melamine, must be applied as a stiffening agent to fix and retain the mesh openings in a uniform diamond shape and in uniform alignment of the openings relative to one another both lengthwise and widthwise of the fabric.

However, because of the severe tendency of the lateral lengthwise edges of the fabric to curl, it is extremely difficult in practice for the operators of tenter frames to properly feed the fabric edges onto the pins or into the clamps of a tenter frame with the mesh openings correctly aligned lengthwise and widthwise without introducing bow or bias into the lengthwise and/or widthwise alignment of the mesh openings. In practice, it has been found to be necessary not only to maintain a sufficiently low speed of the tenter frame to facilitate careful manual feeding of the fabric edges, but it has also been found to be necessary to transport the fabrics through several successive passes through the tenter frame in order to reliably eliminate bow and bias from the mesh openings in the fabric.

Specifically, in a conventional process, the mesh fabric is initially transported through the tenter frame to partially heat set the fabric sufficiently to improve its handleability, after which the stiffening resin is applied and the fabric is transported in a second pass through the tenter frame (or through a second tenter frame) to dry the resin, and then a final pass through the tenter frame (or through a third tenter frame) is made in order to fully heat set the resinated fabric. As will be appreciated, while this conventional process achieves a mesh fabric with satisfactorily uniform widthwise and lengthwise alignment of the mesh openings without bow or bias, the process is very labor-intensive, time-consuming and inefficient and, in turn, the expense of the resultant fabric is substantially increased.

SUMMARY OF THE INVENTION

It is accordingly an object of the present invention to provide an improved open mesh textile fabric which can be inexpensive and efficiently manufactured without introducing undesirable bow or bias into the alignment of the mesh openings. A further object of the present invention is to provide an improved mesh textile fabric with lengthwise-extending selvedges adapted to resist curling. A more particular object of the present invention is to provide an improved warp-knitted open mesh fabric having such characteristics, which can be utilized as a reinforcing material in applications such as the manufacture of pressure hoses and other rubber and synthetic rubber products.

Briefly summarized, the present invention achieves these objectives by providing a mesh textile fabric of a flat warp-knitted construction comprising a lengthwise-extending main fabric body formed in an open mesh stitch pattern and lengthwise-extending fabric selvedges respectively adjoining opposite side margins of the main fabric body for defining the lengthwise side edges of the fabric. Each selvedge is formed in a stabilized stitch construction and of a sufficient width to naturally lay substantially flat in an open-width condition of the fabric against any tendency of the side margins of the main fabric body to induce curling of the selvedges.

Preferably, the selvedges of the fabric are knitted of a stitch density substantially greater than that of the main fabric body, most preferably at least twice the stitch density of the main fabric body. The width of each selvedge is selected to be sufficient to be held by a gripping means of a tenter frame without distorting the laterally-adjacent portion of the main fabric body. In the presently-contemplated embodiments of the present fabric, each selvedge preferably is of a width between approximately one inch and six inches.

The fabric is preferably formed of an at least two-bar warp-knitted construction. In a preferred embodiment, the fabric is of a three-bar warp-knitted construction consisting essentially of flat non-textured yarns forming the main fabric body and textured yarns forming the fabric selvedges. More particularly, the main fabric body comprises a first set of flat body yarns warp knitted in a repeating 1-0, 1-2, 2-3, 2-1 stitch pattern and a second set of flat body yarns warp knitted in a repeating 2-3, 2-1, 1-0, 1-2 stitch pattern, while each selvedge comprises a first set of selvedge yarns warp knitted in a repeating 0-1, 1-0 chain stitch pattern and a second set of selvedge yarns warp knitted in a repeating 2-3, 2-1, 1-0, 1-2 stitch pattern.

DESCRIPTION OF THE PREFERRED EMBODIMENT

As explained more fully herein, the preferred embodiment of the fabric of the present invention is formed on a warp-knitting machine which may be of any conventional type of an at least three-bar construction having three or more yarn guide bars and a needle bar, preferably a conventional Raschel warp-knitting machine (although it is also contemplated that the fabric and variations thereof could also be produced utilizing a tricot or like warp-knitting machine). The construction and operation of such machines are well known in the knitting art and need not herein be specifically described and illustrated. In the following description, the yarn guide bars of the knitting machine are identified as "top," "middle," and "bottom" guide bars for reference purposes only and not by way of limitation. As those persons skilled in the art will understand, such terms equally identify knitting machines whose guide bars may be referred to as "front," "middle," and "back" guide bars, which machines of course are not to be excluded from the scope and substance of the present invention. As further used herein, the "bar construction" of a warp-knitting machine refers to the number of yarn guide bars of the machine, while the "bar construction" of a warp-knitted fabric refers to the number of different sets of warp yarns included in the fabric, all as is conventional terminology within the art.

Figure 1:
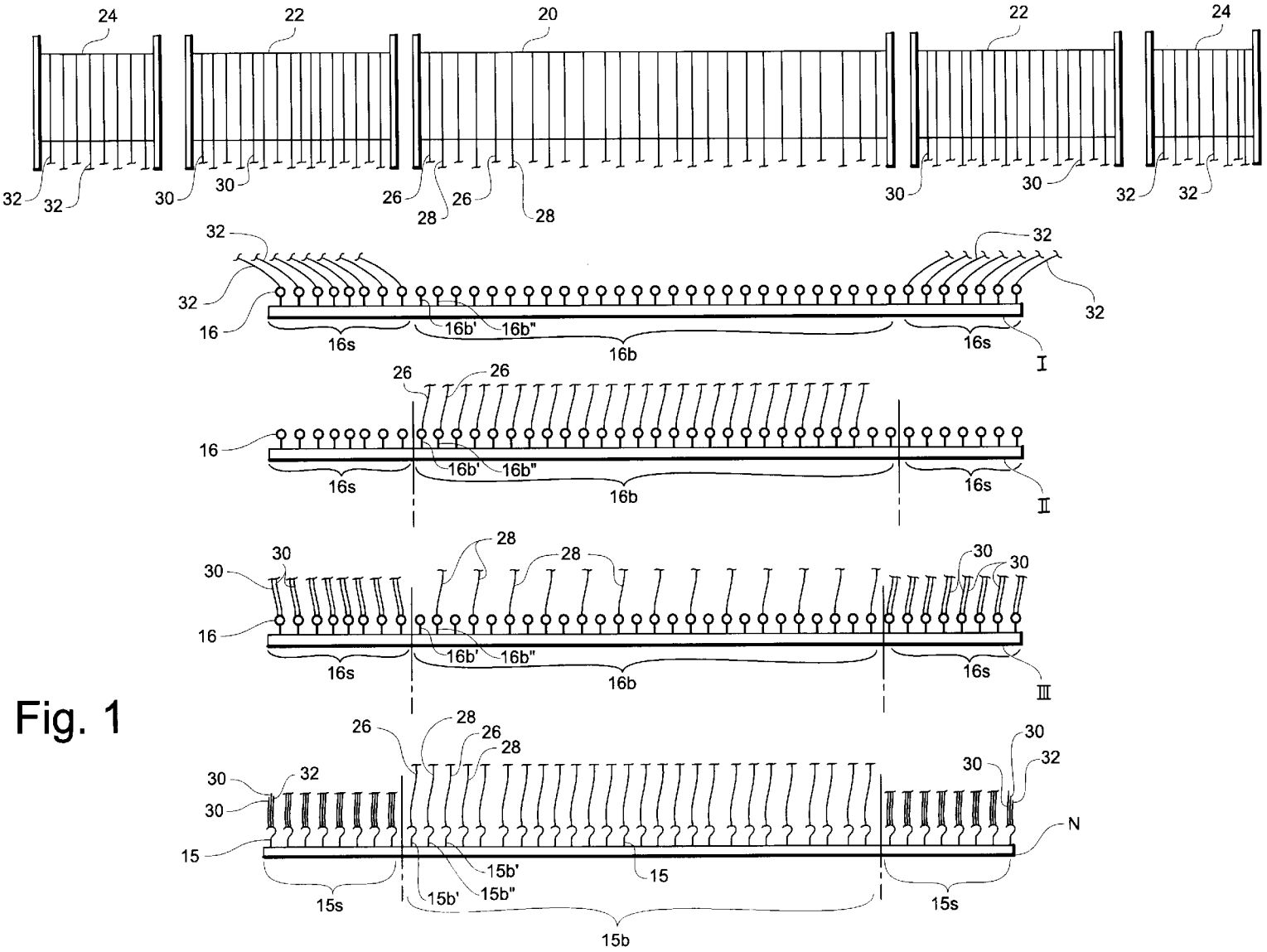
FIG. 1 is a schematic diagram depicting the warps and threading patterns for the body and selvedge yarns on the guide and needle bars of a warp-knitting machine in knitting one preferred embodiment of the present fabric.

As is conventional, the needle bar N of the warp-knitting machine carries a series of aligned knitting needles 15, while each guide bar I, II, III of the machine carries a series of guide eyes 16, the needle and guide bars of the machine preferably having the same gauge, i.e., the same number of needles and guide eyes per inch, all as depicted schematically in FIG. 1. In the accompanying drawings, one particular preferred embodiment of the present warp-knitted fabric of a three-bar construction knitted according to the present invention on a three-bar Raschel warp-knitting machine is illustrated. In particular, the fabric is knitted utilizing three sets of warp yarns respectively wound on and delivered from three separate warp beams, with the accompanying drawings of FIGS. 2 and 3 depicting the stitch constructions of the three sets of yarns as carried out by the respective lateral traversing movements of the guide bars of the knitting machine according to the preferred embodiment of the fabric utilizing a traditional dot or point diagram format, wherein the individual points 15 represent the needles of the needle bar N of the knitting machine in the formation of several successive fabric courses C across several successive fabric wales W.

According to the present invention, a series of guide eyes 16*s* at the opposite ends of each yarn guide bar I, II, III are designated for carrying yarns to be warp knitted into the selvedges of the fabric (e.g., a series of 60 successively-adjacent guide eyes 16*b* at each end of each guide bar), while the series of guide eyes extending between the two groups of selvedge-forming guide eyes 16*s* are designated for knitting the main mesh body of the fabric (e.g., a series of 600 successively-adjacent guide eyes on each guide bar extending between the two sets of selvedge-forming guide eyes). One main warp beam 20 carries a series of warp yarns equivalent in number to the number of guide eyes on each guide bar designated for knitting the main fabric body (e.g., 600 warp yarns), with alternating ones of the warp yarns forming a first set of fabric body yarns 26 being threaded through every alternate guide eye 16*b′* of the middle guide bar II designated for knitting the main fabric body and the intervening yarns forming a second set of fabric body yarns 28 being threaded through every intervening guide eye 16*b″* of the bottom yarn guide bar III designated for knitting the main fabric body. A second warp beam 24 carries a first set of selvedge yarns 32 corresponding in number to the number of guide eyes 16*s* on the guide bars designated for knitting the fabric selvedges (e.g., 120 yarns), which are delivered to and threaded through every guide eye 16*s* of the top yarn guide bar I designated for knitting the fabric selvedges. Similarly, a third warp beam 22 carries a second set of selvedge yarns 30 of a number twice the number of guide eyes 16*s* on the guide bars designated for knitting the fabric selvedges, with two such yarns 30 being threaded through each guide eye 16*s* of the guide bar III designated for knitting the fabric selvedges.

Preferably all of the yarns are multifilament synthetic yarns, such as polyester, but may be of differing denier and filament makeup to achieve and enhance the desirable physical characteristics of the fabric. For example, in the preferred embodiment depicted in the drawings, the body yarns 26, 28 delivered from the warp beam 20 to form the main fabric body are non-textured polyester yarns, commonly referred to in the industry as "flat" yarns, of a relatively high denier, e.g., 450 denier, and the selvedge yarns 30, 32 delivered from the two warp beams 22, 24 are preferably texturized polyester yarns, selected so that the three selvedge yarns 30, 32 delivered to each selvedge needle 15*s* on the needle bar N (i.e., two selvedge yarns 30 from the warp beam 22 and one selvedge yarn 32 from the warp beam 24) collectively have a denier comparable to that of the main body yarns 26, 28, e.g., each selvedge yarn 30, 32 being a 150 denier, 34 filament textured polyester yarn. Of course, those persons skilled in the art will recognize that various other types of yarns may also be employed as necessary or desirable according to the fabric weight, feel and other physical characteristics sought to be achieved.

Figure 2:
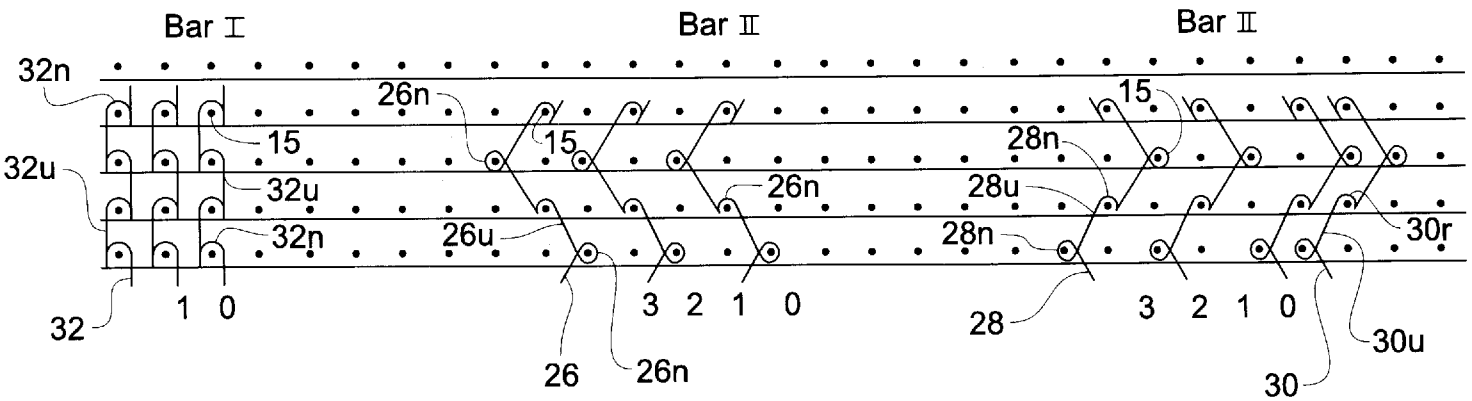
FIG. 2 is a diagram showing individually the stitch patterns for the body and selvedge yarns carried out by the warp-knitting machine schematically shown in FIG. 1 in knitting the preferred embodiment of the present fabric.
Figure 3:
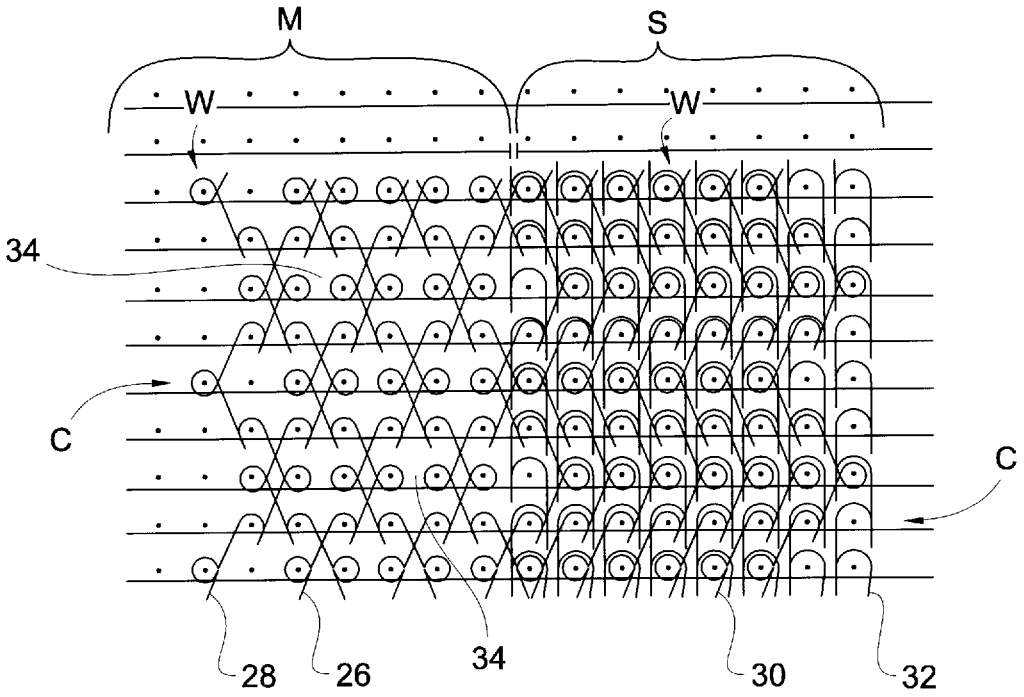
FIG. 3 is a composite diagram showing the stitch patterns of the body and selvedge yarns collectively to schematically represent the resultant fabric.

As diagrammatically depicted in FIGS. 2 and 3, the stitch patterns for the body and selvedge yarns 26, 28, 30, 32 as controlled by the three yarn guide bars I, II, III form the main fabric body M in an open mesh construction defining diamond-shaped openings 34 and form the selvedges S of a stabilized non-mesh stitch construction of essentially twice the stitch density of the mesh construction of the main fabric body M due to the division of the body yarns in the first warp beam 20 into the two sets of body yarns 26, 28 whereby the effective needle gauge utilized in the knitting the main fabric body is one-half the needle gauge utilized in knitting the selvedges S. Specifically, the middle yarn guide bar II of the machine manipulates the first set of body yarns 26 to traverse laterally back and forth relative to the alternate body yarn needles 15*b′* of the needle bar N to stitch the body yarns 26 in a repeating 1-0, 1-2, 2-3, 2-1 stitch pattern (diagrammatically indicated at Bar II of FIG. 2) as the yarns 26 are fed progressively from their respective warp beam 20. Simultaneously, the bottom yarn guide bar III of the knitting machine manipulates the second set of body yarns 28 as they are also fed from the same warp beam 20 to traverse relative to the intervening body yarn needles 15*b″* of the needle bar N to stitch the body yarns 28 in a repeating mirror image 2-3, 2-1, 1-0, 1-2 stitch pattern (diagrammatically indicated at Bar III of FIG. 2). At the same time, the bottom yarn guide bar III identically manipulates the selvedge yarns 30 to traverse relative to the selvedge needles 15*s* in the same 2-3, 2-1, 1-0, 1-2 repeating stitch pattern as the yarns 30 are fed from their respective warp beam 22. The selvedge yarns 32 delivered from the warp beam 24 are simultaneously manipulated by the top yarn guide bar I to traverse relative to the selvedge needles 15*s* in a repeating 0-1, 1-0 chain stitch pattern (as indicated diagrammatically at Bar I of FIG. 2).

As will thus be understood, the body yarns 26, 28 are inter-knitted with one another in their above-described mirror-image stitch constructions, with each body yarn 26, 28 being formed from one fabric course C to the next fabric course C in a series of needle loops 26*n*, 28*n* and in connecting underlaps 26*u*, 28*u* extending between the successive needle loops, whereby the guide bar threading patterns and the respective stitch patterns of the body yarns 26, 28 dispose one of the needle loops 26*n* or 28*n* in every wale W of every course C in the fabric while defining the diamond-shaped mesh openings 34 aligned coursewise, walewise and diagonally throughout the main fabric body M. Within the selvedges S, the selvedge yarns 30 are interknitted with one another in the described stitch construction in needle loops 30*n* and connecting underlaps 30*u* extending between the successive needle loops 30*n,* while the selvedge yarns 32 are interknitted with the selvedge yarns 30 in the described chain stitch pattern forming needle loops 32*n* interknitted in plated relationship with the needle loops 30*n* of the selvedge yarns 30 in every wale W and in connecting chain stitch underlaps 32*u* extending between the successive needle loops 32*n.* In this manner, the chain stitch pattern of the selvedge yarns 32 provides walewise resistance to elongation and distortion within the selvedges S while the coursewise traversing stitch pattern of the selvedge yarns 30 provides coursewise resistance to elongation and distortion within the selvedges S, the selvedge yarns 30, 32 thereby cooperating with one another to provide a highly-stabilized structure to the selvedges.

As such, the selvedges S exhibit a high degree of resistance to curling and tend naturally to lay substantially flat and essentially co-planar with the main fabric body M when the fabric is opened into a flattened full-width condition. In turn, the selvedges S tend to resist any tendency of the immediately-adjacent lateral side margins of the mesh main fabric body M to curl inwardly (i.e., normal to the lengthwise extent of the fabric). Thus, the fabric promotes substantially-uniform winding into cylindrical roll form with suppressed tendency of the side edges of the fabric to cause the roll to enlarge at its lateral ends. To best promote these physical characteristics of the fabric, the selvedges S should be of a minimum width sufficient at least to naturally lay substantially flat in an open-width condition of the fabric against any tendency of the side margins of the fabric body to induce curling of the selvedges and most preferably the selvedges should be sufficiently wide to be capable of being held by a gripping means of a tenter frame (e.g., tenter frame pins or clamps) without imparting distortion to the laterally-adjacent portions of the main fabric body M. Presently it is contemplated that, depending upon the physical characteristics of the main fabric body M which affect the tendency thereof to curl (most significantly, the stitch construction of the main fabric body), each selvedge S should preferably be of a width between approximately one inch and six inches. For example, in the particular preferred embodiment of the fabric depicted in FIGS. 1 and 2, the Selvedges are preferably at least four inches in width.

Advantageously, the curl-resistive characteristics of the present fabric enable the fabric to be much more easily handled and processed subsequent to knitting than the conventional known fabrics described above. Specifically, the tendency for the selvedges S of the fabric to lay essentially flat considerably enhances and improves the handleability of the fabric in feeding into a tenter frame for heat setting such that fabrics in accordance with the present invention should be susceptible of being uniformly fed into a tenter frame at significantly higher lineal traveling speeds than is possible with conventional mesh fabrics while tenter frame operators should still be capable of maintaining coursewise and walewise alignment of the mesh openings without introducing bow or bias into the fabric. In experimental processing of the preferred embodiment of the fabric described above, satisfactory results have been achieved (i.e., bowing and biasing of the mesh openings were maintained at or below acceptable threshold values) utilizing only a single pass of the fabric through a tenter frame at a traveling speed in the range of 30–40 yards per minute, as contrasted to the conventional process described above utilizing three passes of the fabric through a tenter frame at traveling speeds normally not exceeding 20 yards per minute. As those persons skilled in the art will readily recognize, the time and labor expense as well as the efficiency of processing the present fabric will therefore be substantially improved over the best known results achievable using conventional fabrics.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A process for making a fabric to be used as reinforcing material in rubber products like automotive radiator hoses, comprising:

warp-knitting a mesh textile fabric having a lengthwise extending main fabric body formed in an open mesh stitch pattern and lengthwise extending fabric selvedges, respectively adjoining opposite side margins of the main fabric body for defining the lengthwise side edges of the fabric, each selvedge being formed with a sufficient width to naturally lay substantially flat in an open-width condition of the fabric against any tendency of the side margins of the main fabric body to induce curling of the selvedges;

applying a stiffening resin to the mesh textile fabric prior to passing the mesh textile fabric through a tenter frame for heat setting the mesh textile fabric; and then passing the mesh textile fabric only once through a tenter frame for drying the resin and for heat setting the mesh textile fabric.

2. A process according to claim 1, wherein the main fabric body comprises flat non-textured yarns and the selvedges comprise textured yarns.

3. A process according to claim 2, wherein the main fabric body consists essentially of flat non-textured yarns and the selvedges consist essentially of textured yarns.

4. A process according to claim 1, wherein the selvedges are knitted of a stitch density substantially greater than the stitch density of the main fabric body.

5. A process according to claim 4, wherein the stitch density of each selvedge is at least twice the stitch density of the main fabric body.

6. A process according to claim 1, wherein the fabric is formed of an at least two-bar warp-knitted construction.

7. A process according to claim 6, wherein the fabric is formed of a three-bar warp-knitted construction.

8. A process according to claim 1, wherein the width of each selvedge is selected to be sufficient to be held by a gripping pins of a tenter frame without distorting the laterally adjacent portion of the main fabric body.

9. A process according to claim 8, wherein each selvedge is of a width between approximately one and six inches.

10. A process according to claim 1, wherein the open mesh stitch pattern of the main fabric body defines generally diamond-shaped mesh openings.

11. A process according to claim 10, wherein the main fabric body comprises first and second sets of body yarns warp knitted in respective opposed mirror-image stitch patterns.

12. A process according to claim 10, wherein the first set of body yarns is warp knitted in a repeating 1-0, 1-2, 2-3, 2-1 stitch pattern and the second set of body yarns is warp knitted in a repeating 2-3, 2-1, 1-2, 1-2 stitch pattern.

13. A process according to claim 10, wherein each selvedge comprises a first set of selvedge yams warp knitted in a repeating chain stitch pattern and a second set of selvedge yarns warp knitted in a repeating non-chain stitch pattern.

14. A process according to claim 13, wherein the first set of selvedge yarns is warp knitted in a repeating 0-1, 1-2 chain stitch pattern and the second set of selvedge yarns is warp knitted in a repeating 2-3, 2-1, 1-0, 1-2 stitch pattern.

15. The process according to claim 1, wherein the stiffening resin applied to the mesh textile fabric is melamine.

16. The process according to claim 1, wherein the mesh textile fabric is passed through the tenter frame at a speed in the range of 30–40 yards per minute.

* * * * *